United States Patent [19]

Eidem

[11] 3,985,093

[45] Oct. 12, 1976

[54] CHAIN-WIRE ROPE ANCHORING SYSTEMS AND ANCHORING SYSTEMS AND CONNECTORS THEREFOR

[75] Inventor: Brian L. Eidem, Cerritos, Calif.

[73] Assignee: Armco Steel Corporation, Middletown, Ohio

[22] Filed: Apr. 30, 1975

[21] Appl. No.: 572,891

[52] U.S. Cl. ..... 114/206 R; 59/93; 74/230.5; 74/230.24; 114/230

[51] Int. Cl.[2] ..... B63B 21/50

[58] Field of Search ..... 114/206 R, 210, 200, 114/179, 180, 181, 230; 254/175.5, 175.7, 138, 191, 190 R; 74/230.24, 230.5, 229; 403/41; 59/93, 86

[56] References Cited

UNITED STATES PATENTS

| | | | |
|---|---|---|---|
| 682,361 | 9/1901 | Keith | 59/86 |
| 979,567 | 12/1910 | Rosenthal | 74/229 |
| 1,458,354 | 6/1923 | Neller | 254/190 R |
| 2,633,375 | 3/1953 | Wilcoxon | 254/190 R |
| 3,174,273 | 3/1965 | Ehmann | 59/93 |
| 3,583,354 | 6/1971 | Flickinger | 254/190 R |
| 3,685,285 | 8/1972 | Spilhaug | 59/93 |
| 3,842,776 | 10/1974 | Wudtke | 114/206 R |
| 3,912,228 | 10/1975 | Petty et al. | 114/230 |

*Primary Examiner*—Stephen G. Kunin
*Assistant Examiner*—Charles E. Frankfort
*Attorney, Agent, or Firm*—Roylance, Abrams, Berdo & Kaul

[57] ABSTRACT

Anchoring systems, of the type comprising an anchor chain and a wire rope, characterized by a connector between the chain and rope which makes it possible to haul in without stopping to disconnect the hauling line, without requiring preorientation of the connector relative to the combination wheel or wheels over which it passes, and with a smooth transition between chain and rope on the wheel. Advantageous embodiments make it possible for the anchor line, including wire rope, connector, and chain, to traverse a more than 90° change in direction on a single combination wheel without overstressing any component, particularly the end of the wire rope located at the rope-to-chain connection.

15 Claims, 13 Drawing Figures

CHAIN-WIRE ROPE ANCHORING SYSTEMS AND ANCHORING SYSTEMS AND CONNECTORS THEREFOR

BACKGROUND OF THE INVENTION

With the advent of heavy special purpose vessels, particularly offshore drilling vessels or other floating structures, it has become common practice to use anchoring systems comprising a plurality of relatively long anchor lines each including a heavy anchor chain connected to a wire rope. Typical systems employ from one to several thousand feet of anchor chain connected to the anchor and a length of wire rope connected to the end of the chain opposite the anchor. In order to handle such anchor lines, prior-art workers have developed combination wheels or sheaves having an inner groove dimensioned to accommodate the wire rope, and an outer groove, which may be pocketed, dimensioned to accommodate the chain. In some cases, it has been proposed to employ simple link connectors between the anchor chain and the wire rope, but the bending forces in the wire rope at the connection have proved too great for such an arrangement to be completely satisfactory. Accordingly, special connectors have been proposed, but these have suffered from limitations, such as a limit of about 90° change in direction while traversing a wheel or sheave, or a requirement that the connection be oriented in a particular manner before it arrives on the wheel or sheave. The general state of the art is illustrated by the following U.S. Pats:

No. 3,583,354 Flickinger
No. 3,792,622 Lyall
No. 3,842,776 Wudtke

The concept of using two lines of different size connected by a special connection and handled by a combination wheel having concentric grooves to handle the two different size lines is adapted from earlier practice as shown, e.g., in U.S. Pat. No. 1,532,775 to Page. Though anchoring systems of the general type referred to have shown marked advantages over systems employing only an anchor chain or only a wire rope, there has been a continuing demand for improvement of such systems.

OBJECTS OF THE INVENTION

It is accordingly a general object of the invention to devise an anchoring system of the type referred to which overcomes the shortcomings of the prior-art systems and, in particular, enables the wire rope and the chain to be hauled in over the same wheels or sheaves without disconnecting the wire rope from the chain.

Another object is to provide an anchor line comprising an anchor chain and a wire rope interconnected by a connector in such fashion that the connector need not be preoriented in order to pass over a wheel or sheave.

A further object is to provide such an anchor line which can be passed through a change of direction of more than 90° on a single wheel or sheave.

Yet another object is to provide a connector, for connecting a wire rope to an anchor chain, which will limit bending forces applied at the connection, and particularly the bending force applied to the wire rope at the connecting element, such as a rope socket, while the connector traverses a wheel or sheave.

A still further object is to provide an anchoring system of the type referred to, wherein an anchor line comprising a chain and a wire rope is handled on a combination wheel and a smooth transition is accomplished between rope and chain, or between chain and rope, as the line passes over the wheels or sheaves required to handle the line.

SUMMARY OF THE INVENTION

The invention is characterized by the provision of a special connector between the anchor chain and wire rope, the connector including at least one support link which includes a support body having a circular periphery which is concentric with the longitudinal axis of the connector and of curviform radial cross-section, an eye being rigidly carried at each end of the support body, one eye accepting the wire rope termination, e.g., a rope socket, and the other being connected to the anchor chain. At the vessel, the anchor line passes under a fairlead, thence upwardly to at least one combination wheel, typically a pocketed wildcat of an anchor windlass, and thence downwardly into a chain locker, the wire rope only, or both the rope and chain, being led from the chain locker to a wire rope winch on which the rope is wound and into immediate proximity with which the connected end of the chain can be drawn, the arrangement being such that the rope, connector and chain pass over the sheave system in either direction without stopping to disconnect the rope from the chain. Advantageously, the connector comprises a second support link similar to the first, the two support links being interconnected via their adjacent eyes, and the remaining eye of the second support link being connected to the anchor chain, such a connector being capable of traversing, e.g., 180° around a sheave without creation of an excessive bending force in the connected end of the wire rope.

In order that the manner in which the foregoing and other objects are achieved according to the invention can be understood in detail, particularly advantageous embodiments thereof will be described with reference to the accompanying drawings, which form part of the original disclosure of this application, and wherein.

DETAILED DESCRIPTION OF THE EMBODIMENT OF FIGS. 1–9

Figure 1:
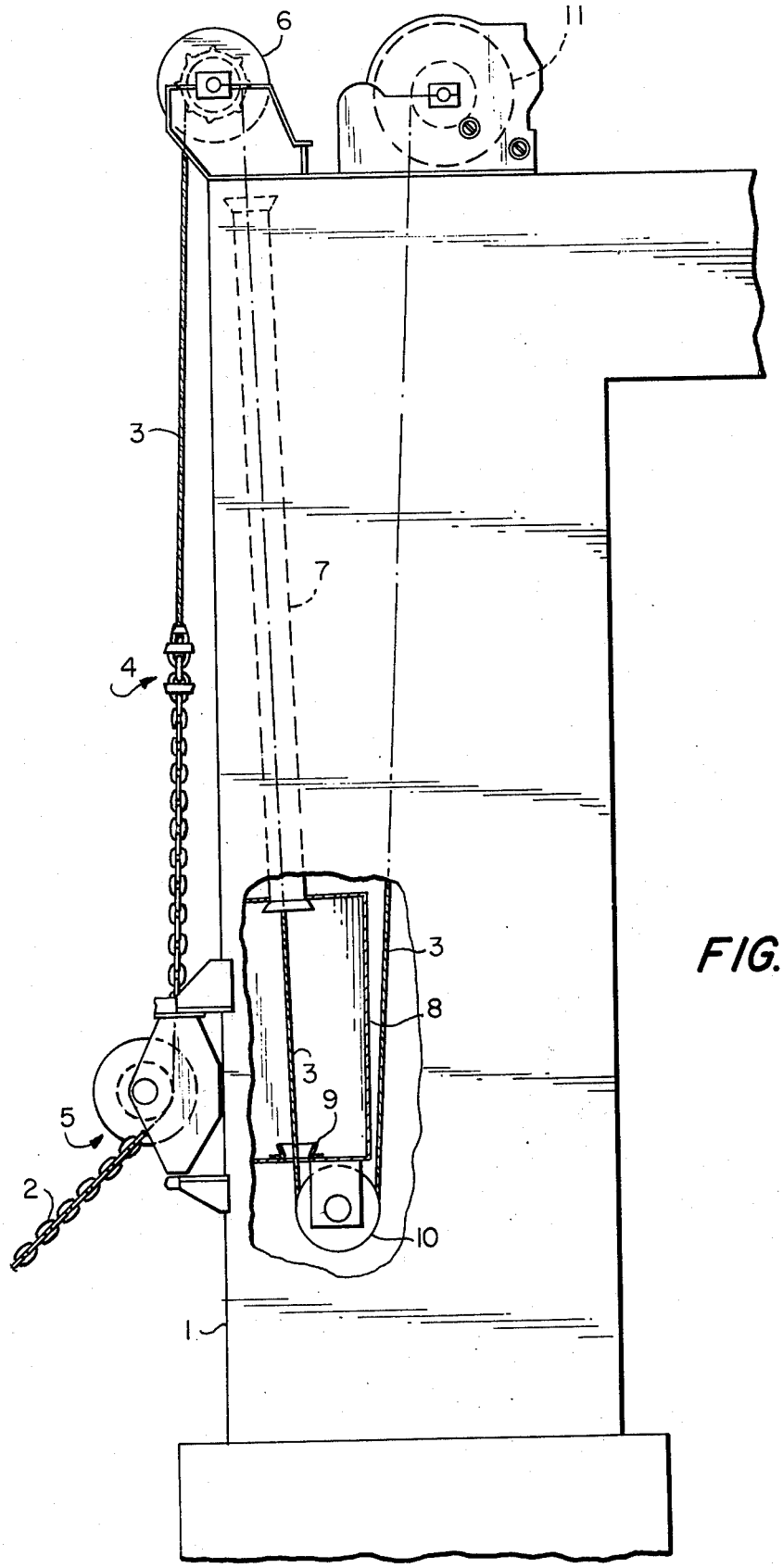
FIG. 1 is a side elevational view, with parts broken away for clarity of illustration, of an anchoring system according to one embodiment of the invention, with only the wire rope present inboard of the anchor windlass.

FIG. 1 illustrates one embodiment of the invention, as applied to one anchor line of a floating, column-stabilized offshore drilling unit, one of the upright columns of the unit being indicated at 1, the anchor line comprising an anchor chain 2, a wire rope 3, and a connector 4 interconnecting the chain and rope. The anchor line extends around a fairlead sheave indicated generally at 5, the fairlead typically being mounted on column 1 in a location which is submerged and being so oriented that the anchor line can extend downwardly and away from the floating unit along a natural catenary to that point at which the end of the anchor chain is secured to a conventional anchor (not shown). For typical installations, the anchor line can be made up of several thousand feet of anchor chain and several thousand feet of wire rope, the chain being, e.g., a 3-inch stud link chain and the rope being, e.g., a 3¼ inch wire rope.

Figure 2:
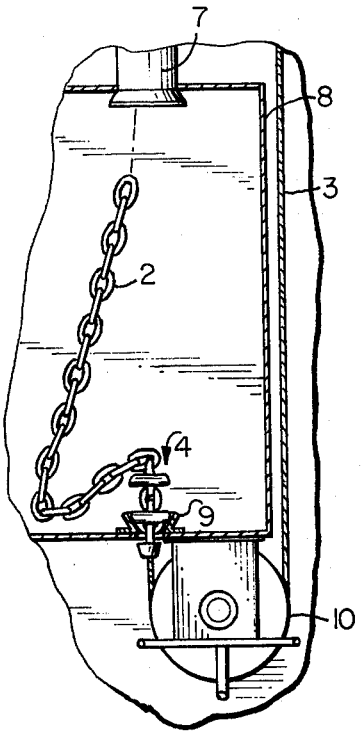
FIG. 2 is a fragmentary view of the chain locker portion of FIG. 1, showing the anchor chain run into the locker.

At a substantial distance above the fairlead, column 1 supports an equipment deck on which is mounted an anchor chain windlass having a wildcat 6 in the form of a pocketed combination wheel. From the fairlead, the anchor line extends upwardly along the column, over the wildcat, and then downwardly through a chain pipe 7 to the chain locker 8. At the bottom of the chain locker there is provided a stopper port 9 dimensioned to pass the wire rope but to be engaged by and stop the connector 4, as seen in FIG. 2. Wire rope 3 extends through port 9, under an idler sheave 10, and thence upwardly to be wound upon the level wind drum 11 of the wire rope winch. While sheave 10 has but a single groove to accommodate the wire rope, the wildcat 6 and fairlead sheave 5 have both an inner groove, to accommodate the rope, and an outer groove, to accommodate the chain, as will be later described in detail.

Figure 3:
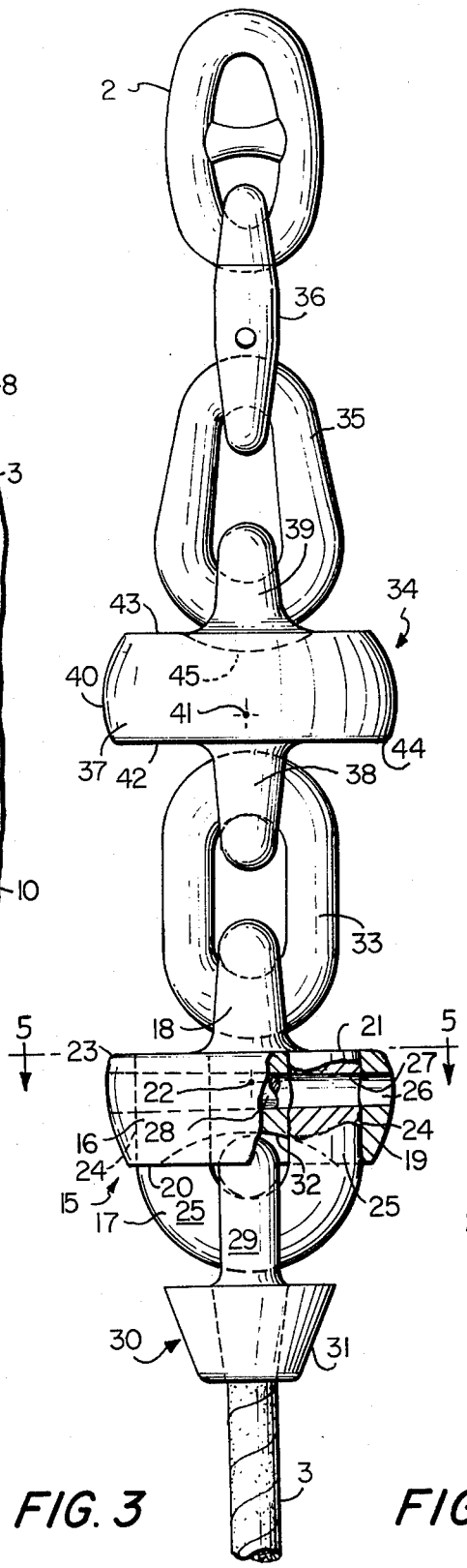
FIG. 3 is a side elevational view, with parts broken away for clarity, of one embodiment of the rope-to-chain connector forming part of the anchoring system of FIG. 1.

As seen in FIG. 3, one particularly advantageous embodiment of the connector 4 comprises a first support link indicated generally at 15 and including a support body 16, a first eye 17 rigidly but detachably carried by body 16 at one end thereof, and a second eye 18 integral with body 16 at the other end thereof. Body 16 has a circular periphery 19 which is concentric with the longitudinal axis of the support link and which is curviform in radial cross-section. Body 16 has flat end faces 20 and 21. The periphery 19 of body 16 is advantageously part of a spherical surface the center 22 of which is substantially nearer end face 21 than end face 20, so that end face 21 is of larger diameter than end face 20 and, in effect, body 16 tapers inwardly toward eye 17. At the larger end of the support body, periphery 19 and end face 21 are joined by a rounded edge 23.

Body 16 has two longitudinally extending, diametrically spaced through bores 24 which are of circular transverse cross-section. Eye 17 is in the form of a U-shaped member, the legs 25 thereof being mutually parallel, spaced apart by the same distance as are bores 24, and of circular transverse cross-section such as to be slidably engageable in bores 24. Body 16 has a diametrically extending straight through bore 26 which is slightly and uniformly tapered from end to end and of a diameter significantly smaller than that of legs 25. Legs 25 are provided with aligned bores 27 of such size and configuration as to form continuations of bore 26 when legs 25 are fully inserted into bores 24 so that the free ends of the legs are coplanar with end face 21. With legs 25 fully inserted in bores 24, a tapered pin 28 is inserted through the bores 26 and 27 to secure eye 17 rigidly to body 16. Eye 17 can be detached from support body 16 by driving pin 28 out of bores 26 and 27. With bores 24 required to accommodate the legs of eye 17, eye 17 lies in a plane at right angles to that of eye 18.

Eye 17 is dimensioned to pass through the eye 29 of a conventional closed wire rope socket 30 secured to the wire rope 3, the eye 29 being integral with the body 31 of the rope socket. For assembly, eye 17 is run through eye 29 and the legs 25 of eye 17 are then inserted into bores 24, eye 17 then being secured to body 16 by driving the pin 28 into place as shown. To reduce the overall length of the assembly, end face 20 of body 16 is provided with a spherical recess 32, the rope socket eye 29 extending partially into the recess.

Support link 15 is connected to anchor chain 2 via an intermediate link 33, a second support link 34, a tapered adaptor link 35 and a conventional joining shackle 36.

Support link 34 is generally similar to support link 25 and comprises a support body 37 and eyes 38, 39. Support body 37 has a circular periphery 40 which is concentric with the longitudinal axis of the support link and is of curviform radial cross-section. The peripheral surface is advantageously spherical, with its center at a point 41 nearer end face 42 than end face 43, so that, in effect, the periphery 40 tapers inwardly toward the anchor chain. A rounded edge 44 is provided between periphery 40 and end face 42. Eyes 38, 39 are coplanar and are integral with support body 37. End face 43 is provided with a spherical recess 45. Adaptor link 35 extends through eye 39 and partially into recess 45, so that eye 39 is effectively shortened to reduce the overall length of the connector.

Intermediate link 33 is a simple welded link extending through eyes 18 and 38.

Figure 7:
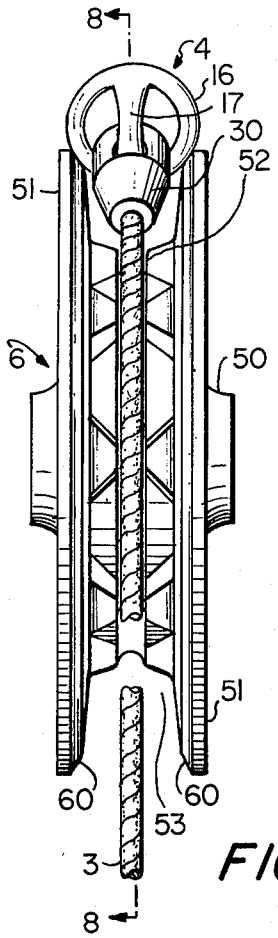
FIG. 7 is an elevational view similar to FIG. 6 but showing the connector passing over the top of the wildcat.

FIGS. 6–9 show details of the wildcat or combination wheel 6 and the relation of the anchor line thereto. Wheel 6 comprises a hub 50 and integral side flanges 51 which are spaced apart axially of the wheel. The wheel has an inner groove 52 which is centered between side flanges 51 and, as seen in FIG. 7, is of semicircular cross-section and dimensioned to accommodate the wire rope 3 with only slight clearance. Inner groove 52 is continuous. The wheel also has an outer pocketed groove 53, FIG. 6, of such configuration and dimensions as to accommodate anchor chain 2 with a driving relation between the wheel and chain. Groove 53 is bisected by groove 52, and each half of groove 53 is defined by the outwardly diverging annular intermediate portions 54 of the inner faces of side flanges 51 and a plurality of groups of surfaces 55–58, the groups of surfaces being arranged in a circular series concentric with the axis of the wheel, with each group of surfaces 55–58 defining a pocket to accommodate one of the alternate links of the anchor chain. Each surface 55 is a flat surface which extends generally tangentially with respect to a circle centered on the wheel axis and slants inwardly to join an extension of the adjacent side wall of inner groove 52 at a rounded edge 59. Surfaces 56 and 58 are flat surfaces each defining half of one end of a pocket, these surfaces slanting, oppositely relative to each other, at an angle relative to the plane of the corresponding flange surface portion 54 and also at an angle to a plane which includes the wheel axis and passes through the midpoint of the associated surface 55. Thus, the surfaces 56 and 58 slant in such fashion as to make the link-receiving pocket larger at the top than at the bottom. Surfaces 57 are flat surfaces which are tangential with respect to a circle centered on the wheel axis, the surfaces 57 being spaced inwardly from surfaces 55 by a distance on the order of the thickness of the chain link to be accommodated. Surfaces 57 are parallel to the wheel axis.

Figure 9:
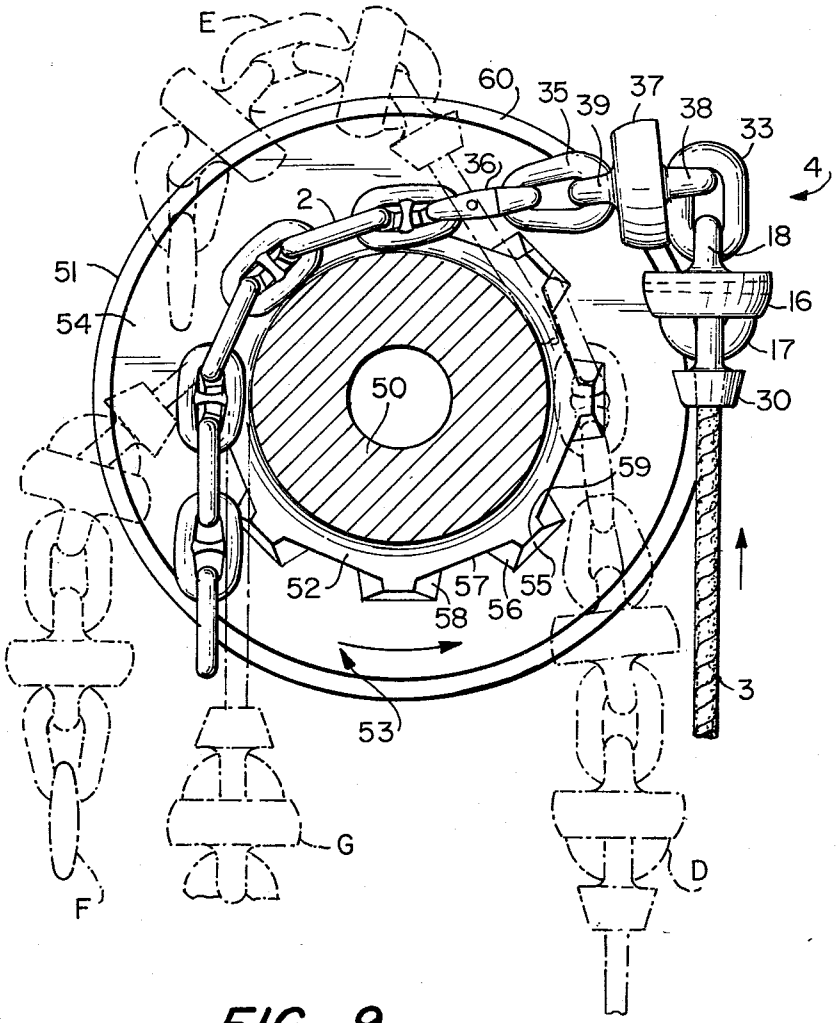
FIG. 9 is a view similar to FIG. 8 but showing positions of the connector, rope and chain relative to the wildcat during paying out of the anchor line.
Figure 8:
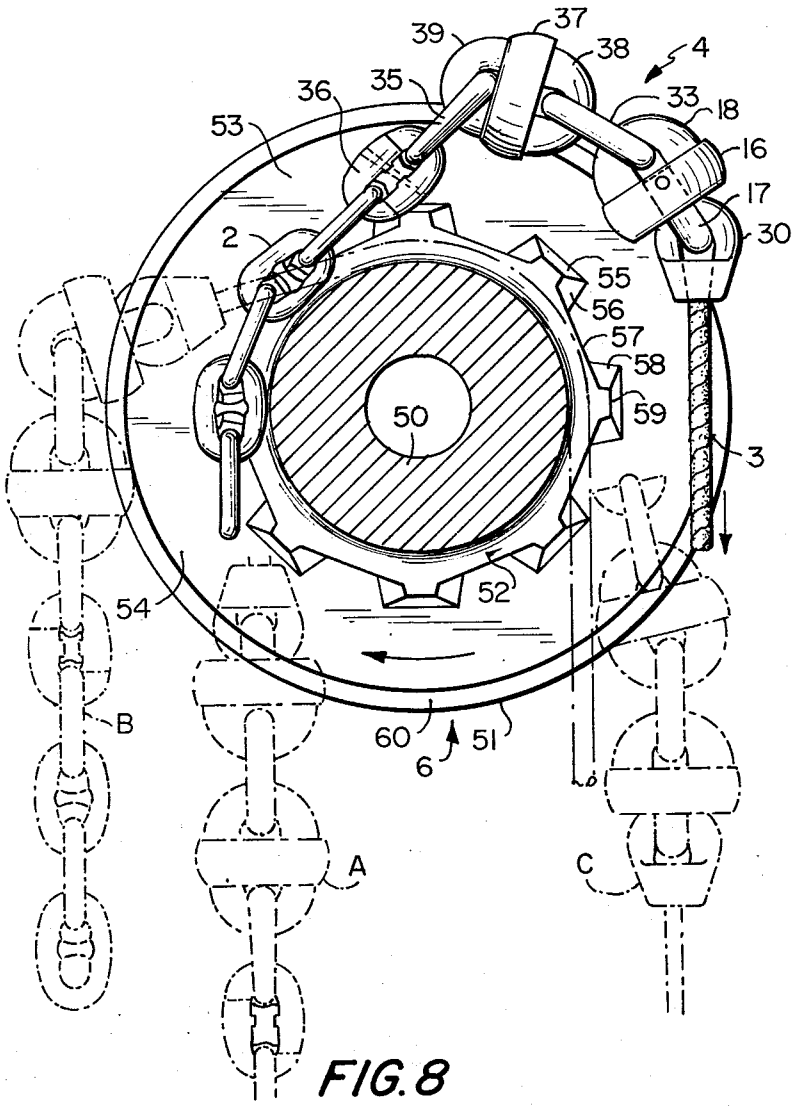
FIG. 8 is a vertical sectional view taken generally on line 8—8, FIG. 7, with the connector, rope and chain shown in solid lines in the position illustrated in FIG. 7 and in phantom lines to illustrate three other positions which occur during clockwise (as viewed) rotation of the wildcat to haul in the anchor line.

As will be clear from FIGS. 8 and 9, the wire rope 3 is directed into the inner groove 52 by surface portions 54 and surfaces 55, and the anchor chain is similarly directed into a position in which alternate links lie flat against surfaces 57 and the other links lie in a plane at right angles to the wheel axis, such other links being seated in the inner groove 52.

The outer peripheral portions of side flanges 51 of the combination wheel 6 are chamferred at 60, with the resulting annular bevelled portions constituting a seat engaged by the support bodies 16 and 37 upon arrival of the connector 4 at the wheel. In effect, the circular peripheries of support bodies 16 and 34 coact with the surfaces 60 to provide a universal joint action, possibly because of the spherical nature of the peripheries of the support bodies, so that, regardless of the tension load applied to the connector 4 via the chain and rope, the support links 15 and 34, being connected via link 33 and eyes 18 and 38, can assume any pair of relative positions necessary to enable the connector 4, and the connected ends of the chain and rope, to traverse a full 180° of the combination wheel 6 without application of an unduly large bending movement to any component of the connection, including the rope adjacent to socket 30 which is the most vulnerable of the components to damage by large bending moments. Thus, during inhauling of the anchor line, the wire rope 3 initially extends 180° around inner groove 52 of wheel 6 and, as connector 4 approaches the wheel, the periphery of support body 16 of link 15 first engages the surfaces 60, as is illustrated by phantom lines at A in FIG. 8. As clockwise rotation of the wheel continues, both support bodies 16 and 37 come into engagement with surfaces 60, and the connector 4 passes through positions of which phantom line illustration B and the solid line illustration, FIG. 8, are illustrative. Finally, as the connector departs the wheel, only support body 37 engages the wheel, as shown by phantom line illustration C, FIG. 8. When the connector has left the wheel, chain 2 extends a full 180° around the pocketed outer groove 53.

As the anchor line is payed out and connector 4 approaches wheel 6, the periphery of support body 37 first engages surfaces 60 of the wheel, as shown by the phantom line illustration at D in FIG. 9. Continued counterclockwise rotation of wheel 6 then causes connector 4 to move into positions in which both support body 37 and support body 16 are in engagements with surfaces 60, two such positions being shown, respectively, by the solid line illustration and the phantom line illustration E, FIG. 9. As the connector 4 departs the wheel, a position is reached in which only support body 16 engages surfaces 60, as shown by the phantom line illustration F, FIG. 9. Upon further counterclockwise rotation, wire rope 3 extends for a full 180° in inner groove 52.

Comparing FIGS. 8 and 9, it will be seen that, for all of the positions assumed by connector 4 on wheel 6 during inhauling or paying out of the anchor line, the tension load applied to rope socket 30 via the rope is substantially in alignment with the longitudinal axis of the rope socket, and there is therefore no application of excessive bending forces to the rope where it enters the socket. This advantage is achieved because of the "universal joint" coaction between the two support bodies of the connector, on the one hand, and the bevelled surfaces 60 of the wheel, on the other hand, and because the connector includes four free pivot points in series, one between the rope socket and eye 17, a second between eye 18 and intermediate link 33, a third between the intermediate link and eye 38, and the fourth between eye 39 and adaptor link 35.

The embodiments of the invention shown in FIGS. 1–9 thus make it possible not only to fully pay out and fully haul in without having to disconnect the anchor chain from the wire rope but also to employ the single combination wheel 6, rather than requiring a second sheave to limit the maximum change of direction to about 90° at any one sheave.

MODIFIED CONNECTOR OF FIG. 10

Figure 4:
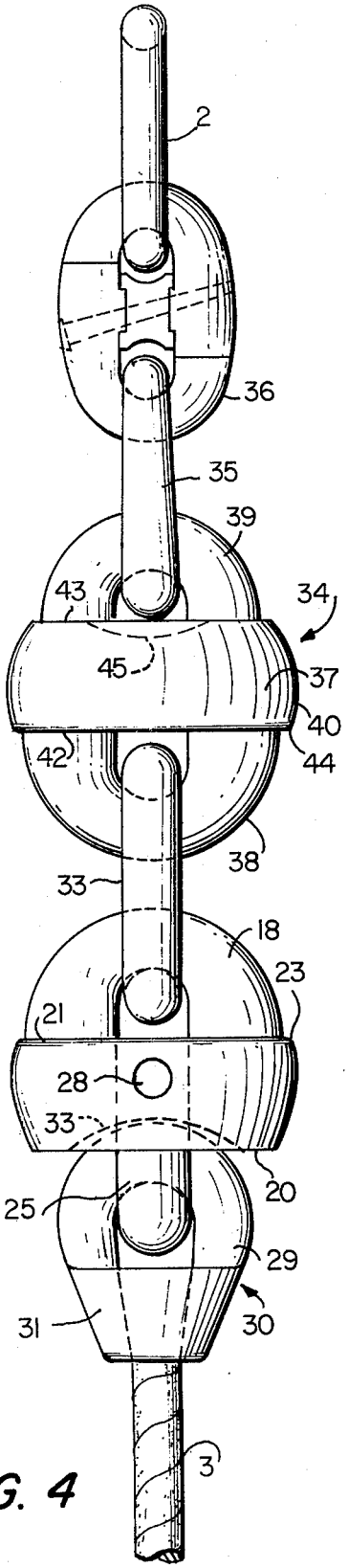
FIG. 4 is a side elevational view similar to FIG. 3 but with the connector rotated 90°, about its longitudinal axis, from the position seen in FIG. 3.
Figure 6:
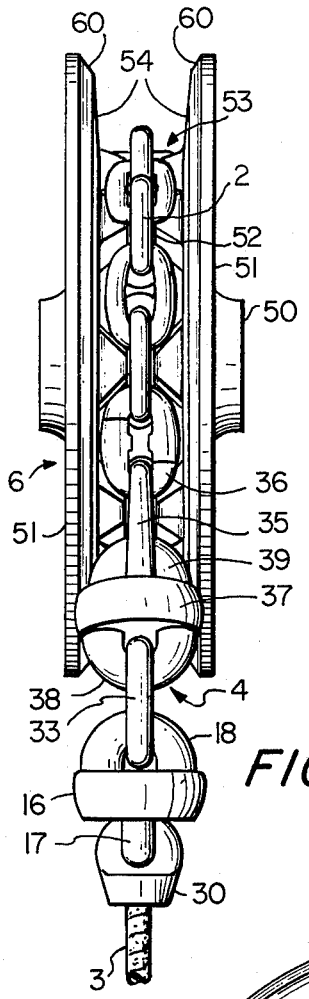
FIG. 6 is an elevational view of the connector of FIGS. 3–5, and the adjacent portions of the chain and rope, in operative relation to a combination wildcat, the view being taken at 90° to the axis of rotation of the wildcat.
Figure 5:
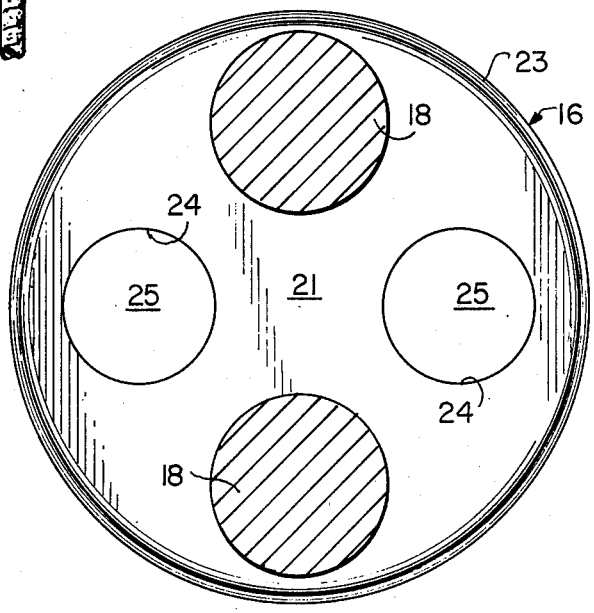
FIG. 5 is a transverse cross-sectional view taken generally on line 5—5, FIG. 3.
Figure 10:
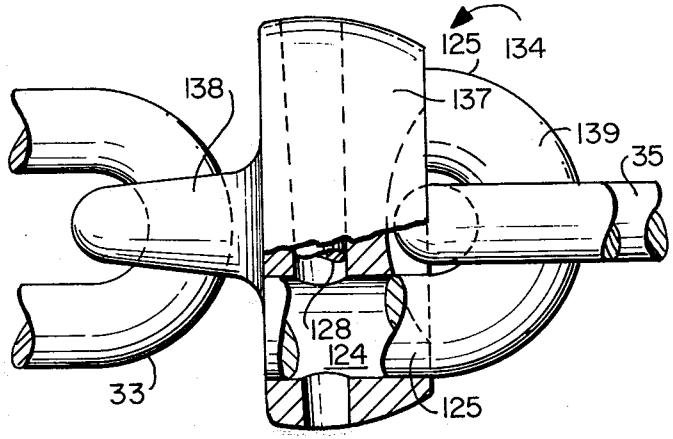
FIG. 10 is a side elevational view similar to FIG. 3, but showing only one of the two support links of the connector, with that link modified to make the anchor chain connecting eye detachable.

As shown in FIG. 10, the connector described with reference to FIGS. 3–5 can be modified so that the anchor chain is detachable at the adjacent support link, with the two support links then being identical. Thus, support link 134 comprises a support body 137 which is integral with the eye 138 to which intermediate link 33 is connected, but eye 139 is in the form of a U-shaped member the straight legs 125 of which are inserted into bores 124 in body 137 and secured thereto by pin 128. The U-shaped member is simply run through adaptor link 35 before legs 125 are inserted into bores 124.

This embodiment of the connector has the advantage of ease of connecting and disconnecting the anchor chain, and the further advantage that, with the two support links identical, stocking of only one part is required.

EMBODIMENT OF FIGS. 11 AND 12

In this embodiment, the anchoring system comprises an anchor line comprising an anchor chain 202 and a wire rope 203 interconnected by a connector 204. The anchor line extends from the anchor (not shown) under the fairlead 205, thence upwardly beside column 201, and over a tension wheel 212 which is pocketless but otherwise constructed as described with reference to the combination wheel 6, FIGS. 7–9, so that the chain traverses an outer groove, the rope is accommodated by an inner groove, and the side flanges present peripheral surface portions spaced apart by a distance somewhat greater than the width of the chain. Beside the tension wheel and aligned therewith is the wildcat 206 of the anchor windlass, the wildcat 206 being identical with wildcat 6 of FIGS. 1 and 6–9. From the wildcat, the anchor line runs downwardly through the vertical chain pipe 207 into chain locker 208.

The chain locker is provided with a stopper port 209 through which the wire rope extends freely but which is dimensioned to be engaged by and stop the connector 204 so that, while the rope can be run out of the chain locker via the stopper port the connector cannot pass that port. Beneath the stopper port, the rope passes beneath idler sheave 210 and thence upwardly to be wound on winch drum 211.

Connector 204 includes a single support link comprising a support body 216, a detachable first eye 217, and a second eye 218 which is integral with the support body. Support body 216 has a circular periphery 219 which is concentric with the longitudinal axis of the connector and is of curvilinear radial cross-section. In this case, periphery 219 is spherical, with the center of curvature 222 located on the axis of the connector midway between the end faces 220 and 221 of body 216. Eye 217 is in the form of a U-shaped member, the legs of which are accommodated by bores in the support body and the legs being secured by a pin 228, all as described with reference to support link 15, FIG. 3. Rope socket 230 is connected to eye 217 as hereinbefore described with reference to FIG. 3. Anchor chain 202 is connected to eye 218 via a conventional anchor shackle 236.

Figure 12:
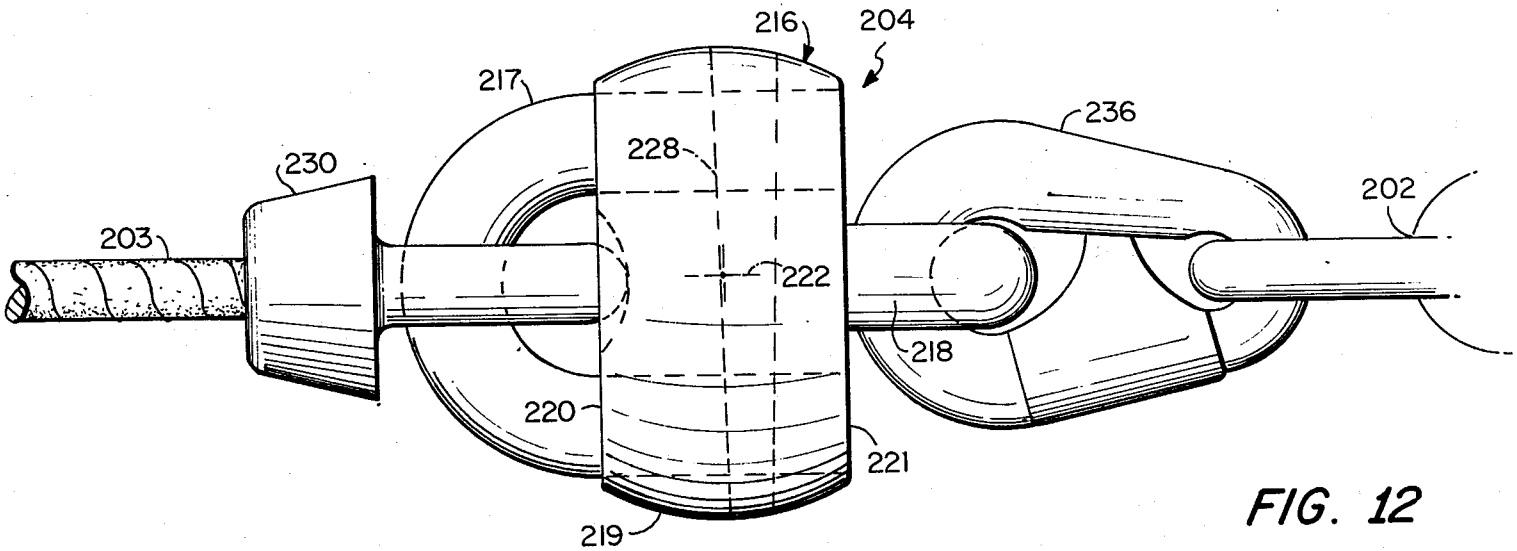
FIG. 12 is a view similar to FIG. 3 of the rope-to-chain connector employed in the anchoring system of FIG. 11.
Figure 11:
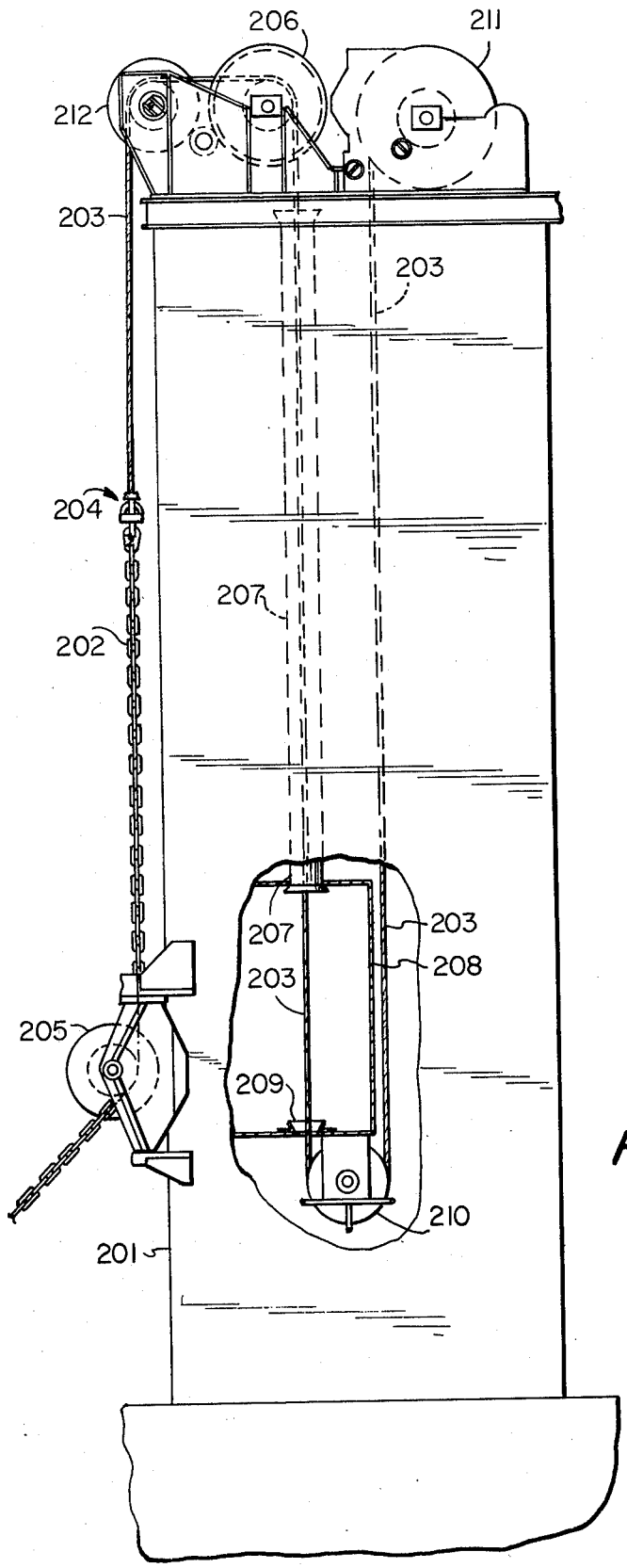
FIG. 11 is a view similar to FIG. 1 illustrating an anchoring system according to another embodiment.

So long as the anchor line changes direction by not substantially more than 90° when traversing any sheave of the system, the connector shown in FIG. 12 functions in generally the same manner hereinbefore described to assure that undue bending forces are not applied, e.g., to the wire rope at the rope socket, and that there is a smooth transition between chain and rope as the connector traverses the sheave.

EMBODIMENT OF FIG. 13

Figure 13:
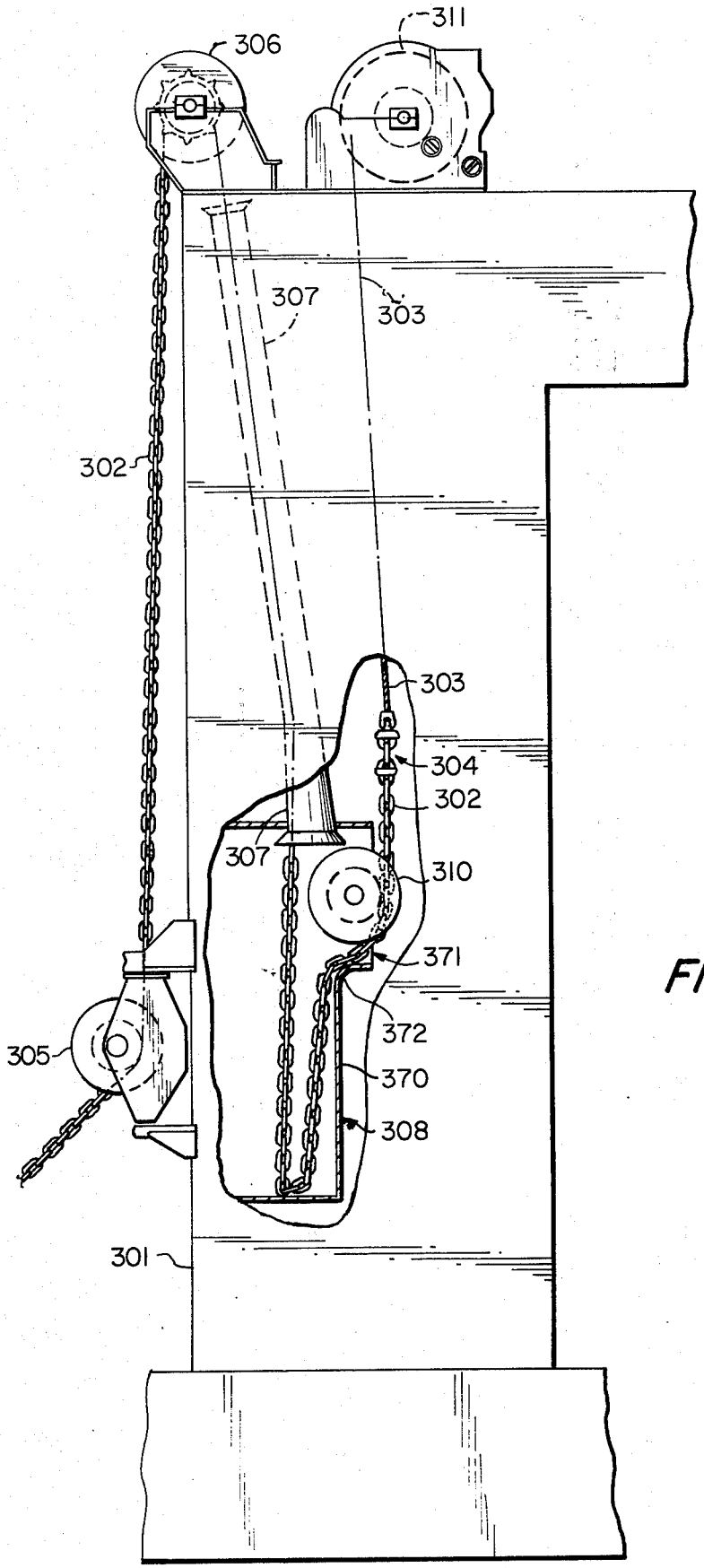
FIG. 13 is a view similar to FIGS. 1 and 11 but showing an anchoring system according to yet another embodiment.

FIG. 13 illustrates an anchor system according to the invention which makes it possible to wind the wire rope to a point such that the connector between the chain and rope is at the equipment deck, so that the connector can be inspected or repaired. In this embodiment, the floating structure comprises a column 301, a fairlead sheave 305, a windlass with a combination wheel 306, a chain pipe 307, chain locker 308 and a winch having a level wind drum 311. The anchor line is the same as in the embodiment of FIGS. 1–9 and includes anchor chain 302, wire rope 303 and connector 304.

In this embodiment, the winch drum is located generally above the wall 370 of the chain locker which is inwardly of column 301, and that wall extends only for a major portion of the height of the locker. There is thus an opening 371 near the top of the chain locker. An idler sheave 310 is mounted within opening 317, this sheave being in the form of a combination wheel which has the same inner-groove-and-outer-groove configuration described with reference to FIGS. 6–9 but which is unpocketed. The upper edge of wall 370 is curved so as to present a convex surface 372 to the interior of the chain locker. Sheave 310 is mounted for free rotation about an axis parallel to the axis of winch drum 311, the diameter of the sheave and its location above surface 372 being such that, when the anchor line has been hauled in to such an extent that a substantial amount of the chain has been stored in the locker, the end portion of the chain connected to the wire rope by connector 304 can be drawn over surface 372, under sheave 310 and thence upwardly until connector 304 is above deck at the wire rope winch. Thus, the chain follows a generally S-shaped path while exiting through opening 371.

Since, though not pocketed, sheave 310 has the general configuration described with reference to FIGS. 6–9, both the wire rope and the chain are positively guided by sheave 310, and connector 304 can traverse the sheave in the same manner described for connector 4.

FIG. 13 is illustrative of embodiment in which the idler sheave is located above, rather than below, the storage space afforded by the chain locker, and it will be understood that the system can be modified, e.g., by having the idler sheave, still in the form of a combination wheel, spaced above the chain locker, even at a location near but below the equipment deck.

In all of the embodiments described, it is unnecessary to make any provision for pre-orientation of the connector relative to the sheave which it is to traverse, since the relationship between the support body or bodies of the connector, on the one hand, and the peripheral portions of the sheave, on the other hand, is not dependent upon the rotational disposition of the connector about its longitudinal axis.

It will be understood that the embodiments of the invention described are illustrative and that various changes can be made therein without departing from the scope of the invention as claimed. Thus, for example, more than one intermediate link can be employed between the two support bodies in the connector shown in FIG. 3 when the diameter of the windlass wheel is especially large in relation to the overall length of the connector.

What is claimed is:

1. In an anchoring system for anchoring a floating structure, the system being of the type comprising an anchor, an anchor chain connected to the anchor, a fairlead mounted on the floating structure to be anchored, a windlass mounted above the fairlead, a chain locker disposed to receive chain from the windlass, a wire rope and a winch for winding the wire rope, the windlass including a combination wheel having an inner groove dimensioned to accommodate the wire rope, an outer groove dimensioned to accommodate the anchor chain, and peripheral flanges spaced apart by a distance larger than the transverse dimension of the anchor chain, the combination of a connector interconnecting the anchor chain and the wire rope and including at least one support link comprising a support body having a circular periphery which is concentric with the longitudinal axis of the connector and is of curviform radial cross-section, a first eye rigidly carried by said support body at one end thereof, a wire rope socket secured to the wire rope and having an eye extending through said first eye, a second eye rigidly carried by said support body at the other end thereof, and means interconnecting the anchor chain and said second eye;

the diameter of said support body being greater than the space between the peripheral flanges of the combination wheel of the windlass, whereby, as said connection traverses the combination wheel, the periphery of said support body engages the peripheral flanges of the combination wheel in free pivotal fashion without requiring that the support link be specially oriented with respect to the combination wheel, the combination of the wire rope, said connector, and the anchor chain being capable of being hauled in via the combination wheel until the wire rope is wound on the winch without disconnecting the wire rope hauling line from the anchor chain.

2. The combination defined in claim 1, wherein said connector comprises only one support link, said means interconnecting the anchor chain and said second eye being a chain link;

the anchoring system being of the type comprising another wheel in addition to the combination wheel of the windlass, the other wheel and the combination wheel being so located that, in passing over the other wheel and the combination wheel, the anchor chain and wire rope do not change direction by substantially more than 90° at each wheel.

3. The combination defined in claim 1, wherein said connector further comprises a second support link comprising a second support body having a circular periphery which is concentric with the longitudinal axis of the connector and is of curviform radial cross-section;

a third eye rigidly carried by said second support body at one end thereof, and a fourth eye rigidly carried by said second support body at the other end thereof, said support links being interconnected via said second and third eyes, the anchor chain being connected to said fourth eye;

the anchoring system being of the type wherein the anchor chain and wire rope change direction by substantially more than 90° in traversing the combination wheel.

4. The combination defined in claim 3, wherein said support link further comprises a chain link passing through and interconnecting said second and third eyes.

5. The combination defined in claim 1, wherein the anchoring system further comprises a sheave located between the winch and the chain locker and via which at least the wire rope passes.

6. The combination defined in claim 5 and further comprising stop means located at the exit of the chain locker and engageable by said connector to stop the anchor line when, as the anchor line is hauled in, said connector arrives at said stop means.

7. The combination defined in claim 3, wherein the anchor system further comprises a second combination wheel, said second combination wheel being located between the winch and the chain locker and having an inner groove dimensioned to accommodate the wire rope, an outer groove dimensioned to accommodate the anchor chain, and peripheral flanges spaced apart by a distance larger than the transverse dimension of the anchor chain but smaller than the maximum transverse dimension of said support bodies, the wire rope, said connector and the chain all being capable of traversing said second combination wheel as the anchor line is hauled in, whereby the wire rope can be wound by the winch until said connector is adjacent the winch and therefore available for inspection and repair.

8. The combination defined in claim 7, wherein the chain locker has a lateral opening spaced a substantial distance above the bottom thereof; and said second combination wheel is mounted in said lateral opening.

9. In an anchor line for vessels such as offshore drilling units, the combination of an anchor chain;

a wire rope; and a connector comprising a support body having a circular periphery which is concentric with the longitudinal axis of the connector and is of curviform radial cross-section, a first eye rigidly carried by said support body at one end thereof, a wire rope socket secured to the wire rope and having an eye extending through said first eye, a second eye rigidly carried by said support body at the other end thereof, and means interconnecting the anchor chain and said second eye, said means interconnecting said anchor chain and said second eye comprising a second support body having a circular periphery which is concentric with the longitudinal axis of the connector and is of curviform radial cross-section, a third eye rigidly carried by said second support body at one end thereof, said first-mentioned support body and said second support body being interconnected via said second and third eyes, a fourth eye rigidly carried by said second support body at the other end thereof, and link means connecting the anchor chain to said fourth eye.

10. The combination defined in claim 9, and further comprising a link extending through said second and third eyes to interconnect said support bodies.

11. A connector for interconnecting an anchor chain and a wire rope comprising, in combination a support link comprising a support body having a circular periphery which is concentric with the longitudinal axis of the connector and is of curviform radial cross-section, a first eye rigidly carried by said support body at one end thereof and through which the eye of a rope socket can extend, a second eye rigidly carried by said support body at the other end thereof, and link means connected to said second eye for connection of an anchor chain said support body being provided with two diametrically spaced longitudinal bores; and said first eye being in the form of a U-shaped member the legs of which extend into said bores and are fixed to said support body said link means including a second support link comprising a second support body having a circular periphery which is concentric with the longitudinal axis of the connector and is of curviform radial cross-section, a third eye rigidly carried by said second support body at one end thereof, and a fourth eye rigidly carried by said second support body at the other end thereof;

said first-mentioned support body and said second support body being interconnected via said second and third eyes, and said fourth eye being adapted to be connected to the anchor chain.

12. A connector according to claim 11, wherein said link means further comprises a link extending through and interconnecting said second and third eyes.

13. A connector according to claim 11, wherein said first-mentioned support body is provided with two diametrically spaced longitudinal bores; and said first eye is in the form of a U-shaped member the legs of which extend each within a different one of said bores and are fixed to said support body.

14. A connector according to claim 13, wherein said second eye is integral with said first-mentioned support body.

15. In a mooring system for a floating structure, said system being of the type having a mooring line including a wire rope, a chain and a connector for joining the wire rope to the chain, the connector being significantly larger than the wire rope, a winch for winding the wire rope, a chain locker having a bottom wall, a fairlead mounted on the exterior of the floating structure, and a windlass mounted above the fairlead, the improvement comprising means defining an opening in said bottom wall of said chain locker, said opening being larger than said wire rope and smaller than said connector; and a sheave rotatably mounted adjacent said opening and outside of said chain locker, said mooring line following a path sequentially defined by said fairlead, said windlass, said chain locker, said sheave and said winch with said connector being stopped at said opening.

* * * * *